US006699414B2

(12) United States Patent
Reinehr et al.

(10) Patent No.: US 6,699,414 B2
(45) Date of Patent: Mar. 2, 2004

(54) METHOD OF PRODUCING ELASTANE FIBER BY WET SPINNING

(75) Inventors: Ulrich Reinehr, Dormagen (DE); Tilo Sehm, Düsseldorf (DE); Wolfgang Anderheggen, Dormagen (DE); Toni Herbertz, Dormagen (DE); Günter Spilgies, Dormagen (DE)

(73) Assignee: Bayer Faser GmbH, Dormagen (DE)

( * ) Notice: Subject to any disclaimer, the term of this patent is extended or adjusted under 35 U.S.C. 154(b) by 8 days.

(21) Appl. No.: 10/209,042

(22) Filed: Jul. 31, 2002

(65) Prior Publication Data

US 2003/0068494 A1 Apr. 10, 2003

Related U.S. Application Data

(62) Division of application No. 09/720,768, filed as application No. PCT/EP99/04178 on Jun. 17, 1999, now Pat. No. 6,492,021.

(30) Foreign Application Priority Data

Jun. 30, 1998 (DE) ..... 198 29 164

(51) Int. Cl.[7] ..... B29D 28/00; B29D 31/00
(52) U.S. Cl. ..... 264/103; 264/177.1; 264/177.17
(58) Field of Search ..... 264/103, 177.1, 264/177.17

(56) References Cited

U.S. PATENT DOCUMENTS

| | | | | |
|---|---|---|---|---|
| 3,526,689 A | | 9/1970 | Jones | 264/103 |
| 4,400,339 A | | 8/1983 | Reinehr et al. | 264/206 |
| 5,007,193 A | | 4/1991 | Goodley et al. | 43/42.28 |
| 5,670,105 A | * | 9/1997 | Reinehr et al. | 264/184 |
| 5,756,205 A | | 5/1998 | Reinehr et al. | 428/364 |
| 6,123,885 A | * | 9/2000 | Kausch et al. | 264/130 |
| 6,602,453 B1 | * | 8/2003 | Reinehr et al. | 264/103 |

FOREIGN PATENT DOCUMENTS

| | | |
|---|---|---|
| DE | 29 51 803 | 7/1981 |
| DE | 42 22 772 | 1/1994 |
| DE | 195 04 316 | 1/1996 |
| EP | 0 031 078 | 7/1981 |
| JP | 10072726 | 3/1998 |

OTHER PUBLICATIONS

P.A. Koch, "Elastanfasern" in Chemiefasern/Textilindustrie Febr. 1979, pp. 97–98.

* cited by examiner

*Primary Examiner*—Stephen J. Lechert, Jr.
(74) *Attorney, Agent, or Firm*—Norris McLaughlin & Marcus

(57) ABSTRACT

Described is wet-spun plural-end elastane yarn having a yarn linear density of up to 2500 dtex, high surface luster and a ribbony cross section and formed from bonded-together individual filaments having an oval to circularly round cross section, the width of the elastane yarn in cross section being at least four times the thickness of the elastane yarn.

15 Claims, 3 Drawing Sheets

METHOD OF PRODUCING ELASTANE FIBER BY WET SPINNING

This application is a divisional application of U.S. Ser. No. 09/720,768 filed Dec. 29, 2000, U.S. Pat. No. 6,492,021.

BACKGROUND OF THE INVENTION

This invention relates to wet-spun plural-end elastane yarn having a yarn linear density of up to 2500 dtex, high surface lustre and a ribbony cross section and formed from bonded-together individual filaments having an oval to circularly round cross section, the width of the elastane yarn in cross section being at least four times the thickness of the elastane yarn.

Elastane yarns are synthetic filament yarns which are produced as mono- or multifilaments—dependent on the intended use—within the linear density range from 11 to about 2500 dtex. Most elastane yarns are coalesced multifilament yarns and possess in their grooved or fluted surface a very specific textile character (compare P. A. Koch "Elastanfasern" in Chemiefasern/Textilindustrie Febr. 1979, page 97–98).

The cross-sectional shape of elastane yarn is substantially dependent on the production process. In the case of dry-spun elastane yarn, the cross-sectional shape will alter in some instances appreciably with the yarn linear density, relatively fine linear densities usually having roundish cross sections and coarser linear densities from about 500 dtex usually having oval to dumbbell-shaped cross sections. This is believed to be due to differences in the degree of evaporation of the spinning solution solvent under the particular spinning conditions. The particular spinning conditions thus influence the onset of coagulation and hence also the degree of shrinkage in the yarn's cross section.

These correlations between the cross-sectional shape and the solvent evaporation rate for dry spinning from polymer solutions, for example of acrylic fibres, are extensively described in the OPI document EP-A-31 078.

Using dry spinning for elastane yarn for medium and coarse titers of about 160 dtex, utilizing jets with several jet openings for glued multifilaments, will usually provides roundish to oval overall cross-sectional shapes, averaged over the entire cross section, medium and higher linear densities produced by wet spinning will usually possess ribbony cross sections in multiple rows, strung up like pearls on a string.

The ribbony cross sections can be advantageous and disadvantageous in the desired final article. The ribbony shape is disadvantageous especially in wide fabric, for example articles having a large area, when its sparkle is unwelcome. On the other hand, ribbony cross sections are also of advantage, for example for the production of diapers. Owing to the wide cross-sectional shape, it is particularly readily possible to apply adhesives to the yarn which lead to firm incorporation and adhesion of the elastic yarn in the diaper article.

Wet-spun elastanes generally have an as-spun filament linear density which is between 15 and 25 dtex.

Known elastane yarn, in addition, has a comparatively dull surface due to the superficial and cross-sectional structure of its individual filaments. In certain applications for the production of textile sheet material, however, particular importance attaches to the visual quality of the fibres, especially their lustre. An objective measure of the lustre is the so-called lustre number which is defined hereinbelow.

The lustre number of existing wet-spinnable elastane yarn is at best on the order of 10 to 20.

SUMMARY OF THE INVENTION

The invention has for its object to provide elastane yarns having a yarn linear density of up to 2500 dtex and a process for their production which have similar mechanical properties to known elastane yarns, a ribbony cross section and a very high surface lustre.

It has now been surprisingly found that raising the filament count whilst keeping the final yarn linear density constant leads to a distinct broadening of the ribbon shape of wet-spun plural-end elastane yarn by up to about 40% compared with the width of known elastane yarn when the as-spun filament linear density is less than 15 dtex, especially not more than 10 dtex.

This object is achieved according to the invention by wet-spun plural-end elastane yarn having a yarn linear density of up to 2500 dtex, high surface lustre and a ribbony cross section and formed from bonded-together individual filaments having an oval to circularly round cross section, the width of the elastane yarn in cross section being at least four times the thickness of the elastane yarn and the as-spun filament linear density being less than 15 dtex.

In particularly suitable elastane yarn, the width of the elastane yarn in cross section is at least five times, preferably at least eight times, particularly preferably at least ten times, the thickness of the elastane yarn.

In elastane yarn of particularly uniform surface quality, the as-spun filament linear density is not more than 10 dtex, preferably not more than 5 dtex.

Preference is given to elastane yarn which has a lustre number of at least 20, preferably of least 40, particularly preferably of at least 100.

Preferably, the elastane yarn comprises polyurethane comprising not less than 85% by weight of segmented polyurethane.

Segmented polyurethane is in particular a segmented polyurethane based on polyethers, polyesters, polyetheresters, polycarbonates or mixtures thereof.

The invention further provides a wet spinning process for producing plural-end elastane yarn having a yarn linear density of up to 2500 dtex, high surface lustre and a ribbony cross section by spinning and especially at least 25% strength by weight elastane solution into a coagulation bath, washing and optionally drawing the yarn formed, drying, setting, spin finishing and winding the yarn, characterized in that the as-spun filament linear density is less than 15 dtex and the individual filaments are converged on a diverting roller in the coagulation bath by means of a comb-type thread guide.

In the preferred process, the as-spun filament linear density is not more than 10 dtex, preferably not more than 5 dtex, particularly preferably not more than 3 dtex so to obtain an almost circularly round cross-sectional shape for the individual filaments.

It is particularly advantageous when the elastane yarn is additionally pressed by a press roller onto the diverting roller after the converging on the diverting roller in the coagulation bath.

The coagulation bath press roller contact pressure is preferably within the range from 1 to 5 bar (0.1 to 0.5 MPa), in particular for elastane yarn having a linear density of up to 1000 dtex 2 to 3 bar (0.2 to 0.3 MPa).

The choice of the as-spun filament linear density, as well as broadening the ribbon shape of the elastane yarn, surprisingly also modifies the cross section of the individual filaments. Whereas an as-spun filament linear density of more than 15 dtex is observed to produce, for example, kidney-shaped filament cross sections, an as-spun filament linear density below 15 dtex, especially of about 10 dtex or less, is found to be accompanied by a change in the cross-sectional shape of the individual filaments into an oval to circularly round shape. At an as-spun filament linear density of less than about 5 dtex, virtually all the filaments present have a round cross-sectional shape. FIGS. 1*a* to 1*c* show the increase in the ribbon width with an increasing filament count for the 800 dtex yarn under otherwise identical spinning conditions. Magnification: 1 cm=about 70 micron. FIGS. 2*a* to 2*c* show individual filament cross sections for various as-spun filament linear densities for the 800 dtex yarn. Magnification: 1 cm=30 micron. As is discernible from FIGS. 2*a* to 2*c*, wet spinning an 800 dtex elastane yarn from a 385 hole jet using an as-spun filament linear density of 4.2 dtex gives round filament cross sections. The surface of such elastane yarn is smoother, has a lower groove depth and hence possesses a particularly high lustre. While an 800 dtex elastane yarn spun from a 172 hole jet using an as-spun filament linear density of 9.4 dtex possesses a lustre number of 60, the lustre number increases to 100 for an as-spun filament linear density of 4.1 dtex (cf. Tab. I1, Examples 6 and 8).

The distinctly higher lustre of the elastane yarn of the invention, which is particularly noticeable in sheetlike articles, is attributable to the smooth and unfibrillated surface of the filaments. The elastane yarn, moreover, has only weakly developed flutes parallel to the fibre axis, which are not interrupted, so that light incident on the elastane yarn is reflected by the individual filaments in a directional manner.

Reducing the as-spun filament linear density whilst increasing the filament count in spinning causes as stated a broadening of the elastane yarn. In the same way, applying additional pressure on the yarn, after coagulation in the coagulation bath, by means of a special squeeze roller which rests on a diverting roller for the yarns which is disposed in the coagulation bath leads to a further increase in the ribbon width of about 30–40% depending on the as-spun filament linear density (cf. Table 2, Examples 6–9).

In general, a yarn linear density of up to 2500 dtex requires a contact pressure of 1 to 5 bar (0.1 to 0.5 MPa) so that this effect may be obtained. In the case of a yarn linear density of up to 1000 dtex, a contact pressure of 2 to 3 bar (0.2 to 0.3 MPa) has proved particularly suitable. A particularly suitable means has proven to be an elastomeric press roller of about 50–100 Shore hardness, whose contact pressure is pneumatically controllable via compressed air.

The invention further provides for the use of the wet-spun elastane yarn according to the invention for producing textile goods, preferably sheetlike goods, especially for producing consecutive course formation knits, wovens or synchronous course formation knits.

The invention also provides for the use of the wet-spun elastane yarn according to the invention for producing disposable hygiene articles, especially for producing diapers.

The ribbon width is reported in the Examples in "micron" ($\mu$m). 1 cm is in each case equal to 10,000 micron.

The as-spun filament linear density (ASFLD) is calculated as follows:

$$ASFLD = \frac{F \times K \times 0.94 \times 100}{A \times Z} \text{ (dtex)}$$

where

F=pumpage rate of spinning solution (ccm/min)

K=concentration of spinning solution (% by weight)

A=coagulation of speed (m/min)

Z=number of jet holes

The as-spun filament linear density is a measure of the filament weight immediately following exit of the spinning solution into the coagulation bath.

Measurement of Lustre Number

The elastane yarns are wound flat onto black metal plates so that the surface of the plate is completely covered by elastane yarn. The luminance of the wound yarn is measured as a function of the scattering angle using a goniphotometer. The angle of incidence is 45°. A plate of barium sulphate serves as the non-lustrous standard.

$$\text{Lustre number } z = \frac{\text{Reflectance of sample at 45 degrees}}{\text{Reflectance of sample at 0 degrees}}$$

The Examples hereinbelow illustrate the invention. Parts and percentages are by weight, unless otherwise stated.

BRIEF DESCRIPTION OF THE DRAWINGS

Embodiments of the invention will now be more particularly described with reference to the figures without thereby wishing to restrict the invention in detail.

In the figures.

DETAILED DESCRIPTION OF THE PREFERRED EMBODIMENTS

EXAMPLES

Example 1

Figure 1A:
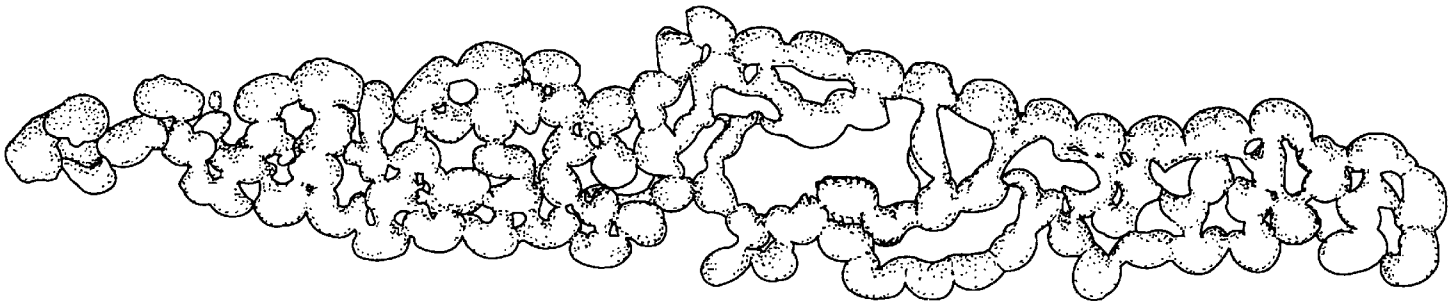
FIG. 1*a* shows a cross section through an 800 dtex 96 filament elastane yarn
Figure 1B:
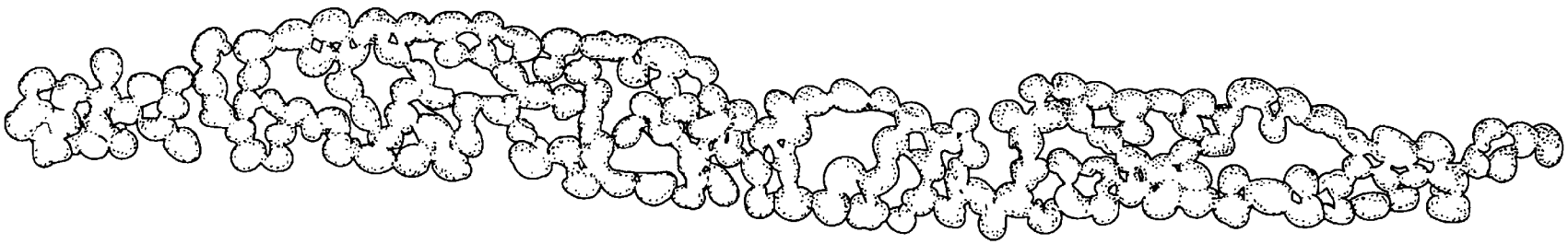
FIG. 1*b* shows a cross section through an 800 dtex 172 filament elastane yarn
Figure 1C:
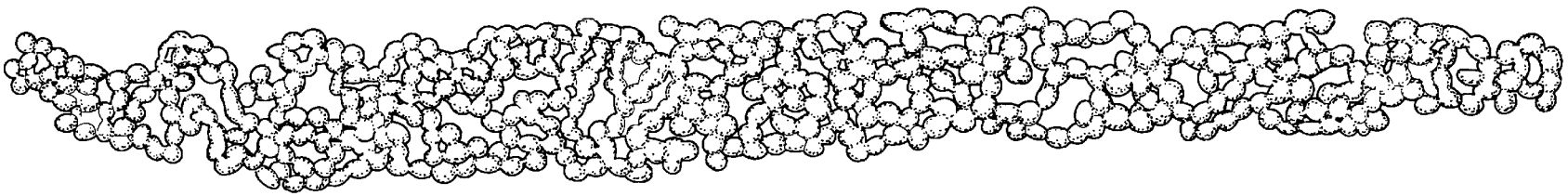
FIG. 1*c* shows a cross section through an 800 dtex 385 filament elastane yarn
Figure 2A:
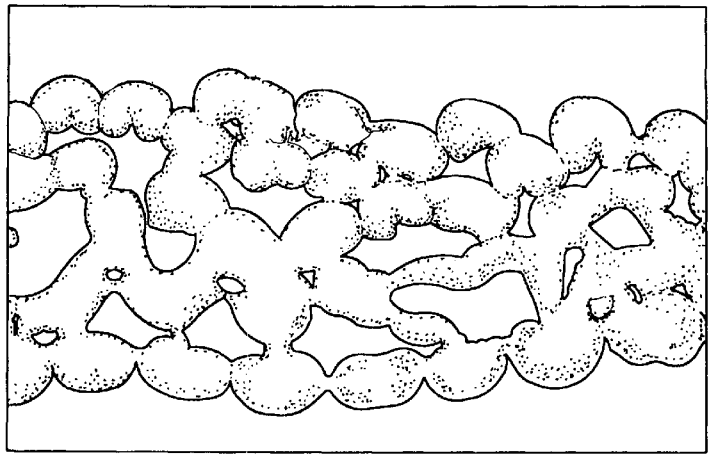
FIG. 2*a* shows part of a cross section through an 800 dtex 96 filament elastane yarn
Figure 2B:
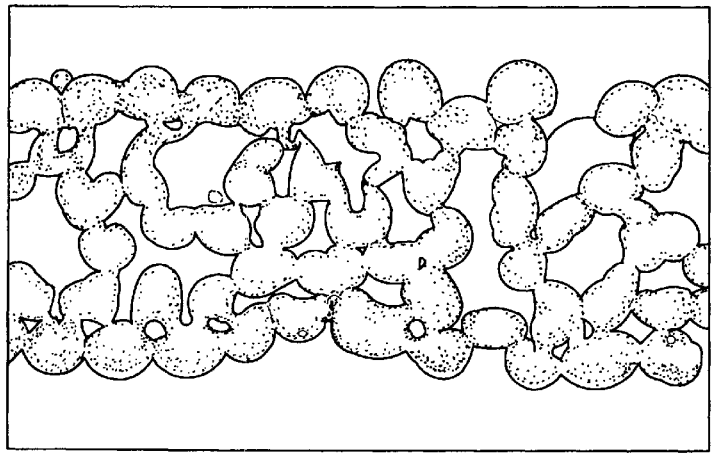
FIG. 2*b* shows part of a cross section through an 800 dtex 172 filament elastane yarn
Figure 2C:
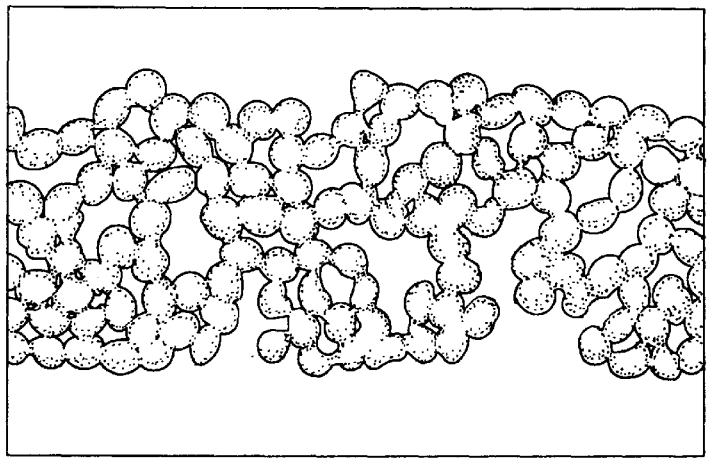
FIG. 2*c* shows part of a cross section through an 800 dtex 385 filament elastane yarn

A 30% strength by weight elastane spinning solution prepared according to Example 7 of DE-A-42 22 772, the spinning solution having been pretreated with 0.5% of diethylamine at 140° C. for about 10 min and having a spinning viscosity of 18 Pa·s measured at 50° C., was spun through a 397 hole jet having a jet hole diameter of 0.08 mm into a coagulation bath containing 20% strength DMAC-water solution The coagulation bath temperature was 85° C. The filaments were taken off at 90 m/min via a diverting roller disposed just above the coagulation bath liquid, coalesced and then washed in a wash bath featuring a pair of rollers by six-fold wrapping around the two wash rollers, which corresponds to a residence time of about 4 seconds.

After the set of filaments had been put in place, a squeeze roller, which merely contacts the elastane yarn leaving the wash roller in the direction of the dryer setting rollers was placed against the upper wash roller. The contact pressure of the squeeze roller was 10 N. The wash bath temperature was 95° C. The squeeze roller had a hardness of 70 Shore and a contact pressure of 2 N/cm of roller width. The contact pressure is adjustable through the addition of various counterweights. The folded yarn was then passed over two heated rollers by being wrapped around the two heated rollers 12 times and treated at 240° C., which corresponds to a contact time of about 5 seconds. This was followed by spin finishing, and the folded yarn was wound up at 120 m/min.

The yarn had a linear density of 795 dtex, a tenacity of 0.86 cN/dtex and an elongation at break of 661%. The as-spun filament linear density (ASFLD) was 2.7 dtex. The examination under the microscope reveals a ribbony filament cross section featuring round individual filaments. The ribbon width is 1310 micron. So the ribbon width is about 38% larger than that of Example 2 of Table 1, where a similar linear density was spun from a 96 hole jet. The yarn surface is smooth and almost groove- and flute-free. The only weakly expressed longitudinal flutes extend parallel to the fibre axis. The elastane yarn has a distinctly higher lustre level compared with the elastane yarn of Example 2. The lustre number is 230!

Examples 2–5

Table 1 summarizes further examples of wet-spun elastane yarn having a linear density of 800 dtex which was produced according to Example 1, except that different hole numbers and a coagulation bath speed of 60 m/min were used. As is discernible from Table 1, the ribbon width increases considerably with a finer as-spun filament linear density (cf. Examples 3–5).

Examples 6–9

A portion of the spinning solution was spun from 172 hole and 385 hole jets as described in Example 1. The only difference was an additional squeeze roller which rests on the diverting roller in the coagulation bath. The contact pressure of the squeeze roller, pneumatically controlled using compressed air, was 2 bar (0.2 MPa). The 800 dtex elastane yarn had the as-spun filament linear densities, ribbon widths and lustre numbers reported in Table 2. As is discernible from Table 2, the use of a squeeze roller on top of the diverting roller in the coagulation bath increases the ribbon width by up to 40% of the original starting length. The shape of the individual filaments and the yarn surface correspond to those reported in Example 1. As is further discernible from Table 2, the lustre number increases considerably with finer as-spun filament linear densities, whereas the ribbon width has no effect on the lustre number. These findings have general validity and are applicable to wet-spun elastane yarns of other linear densities as well.

TABLE 1

| No. | Jet hole number/ Ø mm | As-spun filament linear density (dtex) | Individual filament cross section | Ribbon width (micron) | Change in ribbon width compared with control (%) |
|---|---|---|---|---|---|
| 2 | 96/0.15 | 16.8 | oval to kidney-shaped | 950 | control |
| 3 | 162/0.08 | 10 | oval to round | 1050 | 21 |
| 4 | 172/0.1 | 9.4 | oval to round | 1160 | 22 |
| 5 | 385/0.08 | 4.2 | round | 1250 | 31.5 |

TABLE 2

| No. | Jet hole number/ Ø mm | As-spun filament linear density (dtex) | Squeeze roller in coagulation bath | Ribbon width (micron) | Change in ribbon width compared with control (%) | Lustre number |
|---|---|---|---|---|---|---|
| 6 | 172/0.1 | 9.4 | without | 1100 | — | 60 |
| 7 | 172/0.1 | 9.4 | with | 1450 | 32 | 44 |
| 8 | 385/0.08 | 4.1 | without | 1350 | — | 100 |
| 9 | 385/0.08 | 4.1 | with | 1875 | 39 | 158 |

What is claimed is:

1. Wet spinning process for producing plural-end elastane yarn having a yarn linear density of up to 2500 dtex, high surface lustre and a ribbony cross section by spinning an elastane solution into a coagulation bath, washing and optionally drawing the yarn formed, drying, setting, spin finishing and winding the yarn, wherein the as-spun filament linear density is less than 15 dtex and the individual filaments are converged on a diverting roller in the coagulation bath by means of a comb-type thread guide.

2. Process according to claim 1, wherein the as-spun filament linear density is not more than 10 dtex.

3. Process of claim 2, wherein said linear density is not more than 5 dtex.

4. Process of claim 3, wherein said linear density is not more than 3 dtex.

5. Process according to claim 1 wherein the elastane yarn is additionally pressed by a press roller onto the diverting roller after the converging on the diverting roller in the coagulation bath.

6. Process according to claim 5, wherein the contact pressure of the press roller in the coagulation bath is within the range from 1 to 5 bar.

7. Process of claim 6, wherein said contact pressure is from 0.1 to 0.5 Mpa.

8. Process according to claim 5, wherein the contact pressure of the press roller in the coagulation bath is 2–3 bar for elastane yarn having a yarn linear density of up to 1000 dtex.

9. Process of claim 8, wherein said contact pressure is 0.2 to 0.3 Mpa.

10. Process according to claim 5 wherein the press roller in the coagulation bath has a Shore hardness of 50 to 100 and the contact pressure of the press roller is controlled pneumatically.

11. A method for producing textile goods which comprises producing said textile goods from the wet-spun elastane yarn of claim 1.

12. Method of claim 11 wherein said goods are consecutive course formation knits or synchroneous course formation knits.

13. A method for producing disposable hygiene articles which comprises producing said hygiene articles from the wet-spun elastane yarn of claim 1.

14. Method of claim 13, wherein said articles are diapers.

15. Process of claim 1, wherein said elastane solution is at least 25% strength by weight.

* * * * *